US008989614B2

(12) United States Patent
Yokokawa

(10) Patent No.: US 8,989,614 B2
(45) Date of Patent: Mar. 24, 2015

(54) IMAGE FORMING APPARATUS INCLUDING A TEMPERATURE DIFFERENCE PROVIDING UNIT PROVIDING A RELATIVE TEMPERATURE DIFFERENCE FOR A CONVEYED SHEET

(71) Applicant: Canon Finetech Inc., Misato-shi, Saitama-ken (JP)

(72) Inventor: Kazuki Yokokawa, Tokyo (JP)

(73) Assignee: Canon Finetech, Inc., Misato-shi (JP)

( * ) Notice: Subject to any disclaimer, the term of this patent is extended or adjusted under 35 U.S.C. 154(b) by 44 days.

(21) Appl. No.: 13/738,246

(22) Filed: Jan. 10, 2013

(65) Prior Publication Data

US 2013/0183059 A1 Jul. 18, 2013

(30) Foreign Application Priority Data

Jan. 16, 2012 (JP) ..... 2012-006216
Dec. 4, 2012 (JP) ..... 2012-265231

(51) Int. Cl.
*G03G 21/20* (2006.01)
*G03G 15/00* (2006.01)

(52) U.S. Cl.
CPC ..... *G03G 21/206* (2013.01); *G03G 15/6576* (2013.01)
USPC ..... 399/92; 399/406

(58) Field of Classification Search
USPC ..... 399/92, 94, 406, 407
See application file for complete search history.

(56) References Cited

U.S. PATENT DOCUMENTS 5,084,731 A * 1/1992 Baruch ..... 399/406
2010/0329726 A1* 12/2010 Kasuga ..... 399/92

FOREIGN PATENT DOCUMENTS

JP 62-146149 9/1987
JP 2011-022332 A 2/2011
JP 2011-145365 * 7/2011
JP 2011-145365 A 7/2011

OTHER PUBLICATIONS

Japanese Office Action dated Apr. 1, 2014, issued in counterpart Japanese Application No. 2012-265231.
Japanese Office Action dated Dec. 10, 2013, issued in counterpart Japanese Application No. 2012-265231.

* cited by examiner

*Primary Examiner* — Sandra Brase
(74) *Attorney, Agent, or Firm* — Fitzpatrick, Cella, Harper & Scinto

(57) ABSTRACT

An image forming apparatus is provided that can prevent a winding jam of a sheet, which can be caused owing to curling of the sheet at the front end in the sheet conveying direction.

7 Claims, 13 Drawing Sheets

IMAGE FORMING APPARATUS INCLUDING A TEMPERATURE DIFFERENCE PROVIDING UNIT PROVIDING A RELATIVE TEMPERATURE DIFFERENCE FOR A CONVEYED SHEET

BACKGROUND OF THE INVENTION

1. Field of the Invention

The present invention relates to an image forming apparatus including a fixing device that heats and fixes a toner image transferred onto a sheet.

2. Description of the Related Art

Conventionally, an electrophotographic scheme has been widely adopted in image forming apparatuses, such as copiers and printers. An image forming apparatus adopting the electrophotographic scheme develops an electrostatic latent image formed on an image carrier with toner to form a visual image (form a toner image), transfers the image onto a sheet and subsequently fixes the image with heat and pressure. Thus, the image forming apparatus adopting the electrophotographic scheme includes a fixing device that fixes an unfixed toner image on the sheet by heating and applying pressure.

The fixing device typically includes a fixing roller or a fixing film as a heater, and a pressure roller pressed against the heater, and conveys a sheet while sandwiching the sheet at a nip between the heater and the pressure roller, thereby heating and applying pressure to an unfixed toner image transferred onto the sheet. Accordingly, when the sheet passes the nip between the heater and the pressure roller, moisture on the surface on one side of the sheet (surface on a heated side) may sometimes be evaporated by heating to make opposite ends of the sheet in the conveying direction (front and rear ends) curl.

Although depending on the material and the fibrous direction of the sheet in addition to the amount of moisture in the sheet, the sheet typically curls such that a surface where the amount of moisture is reduced by evaporation of the moisture due to heating shrinks. The sheet thus curls on a side with a relatively large shrinkage. Curling of the opposite ends in the sheet conveying direction causes a possibility of a winding jam where a sheet winds around a conveyor roller conveying the sheet. The winding jam is not preferred because it is not easy to remove the sheet winding around the conveyor roller.

To address the problem, an image forming apparatus has been proposed that includes a cooling unit that cools a conveyed sheet at the downstream side of a fixing device in the sheet conveying direction to thereby reduce the curl at the opposite ends of the sheet in the sheet conveying direction (see Japanese Utility Model Application Laid-Open No. S62-146149).

The image forming apparatus described in Japanese Utility Model Application Laid-Open No. S62-146149 causes the cooling unit to cool the entire sheet and reduces evaporation of moisture, which can prevent the sheet from curling at the opposite ends in the sheet conveying direction to a certain extent but cannot sufficiently suppress curling at the opposite ends in the sheet conveying direction that may be caused by relative difference between shrinkages. Accordingly, the possibility of a winding jam still remains.

It is thus an object of the present invention to provide an image forming apparatus capable of preventing a winding jam of a sheet that can be caused by curling of the sheet at the front end in the sheet conveying direction.

SUMMARY OF THE INVENTION

In the present invention, an image forming apparatus includes: an image forming unit that forms a toner image, and transfers the formed toner image onto a sheet; a fixing unit that heats the sheet onto which the toner image is transferred by the image forming unit to fix the toner image on the sheet; and a temperature difference providing unit that is disposed on a sheet conveying path on a downstream side of a sheet conveying direction of the fixing unit, applies a relative temperature difference in a sheet width direction orthogonal to the sheet conveying direction of the sheet passing on the sheet conveying path, and causes the passing sheet to curl at at least one position in the sheet width direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Image forming apparatuses according to embodiments of the present invention will hereinafter be described with reference to drawings. The image forming apparatuses according to embodiments of the present invention are copiers, printers, facsimiles and multifunction apparatuses thereof that adopt the electrophotographic scheme forming toner images. Description will hereinafter be made using a copier adopting the electrophotographic scheme (hereinafter, simply referred to as a "copier") as an image forming apparatus.

First Embodiment

A copier 1 according to a first embodiment of the present invention will be described with reference to FIGS. 1 to 4.

Figure 1:
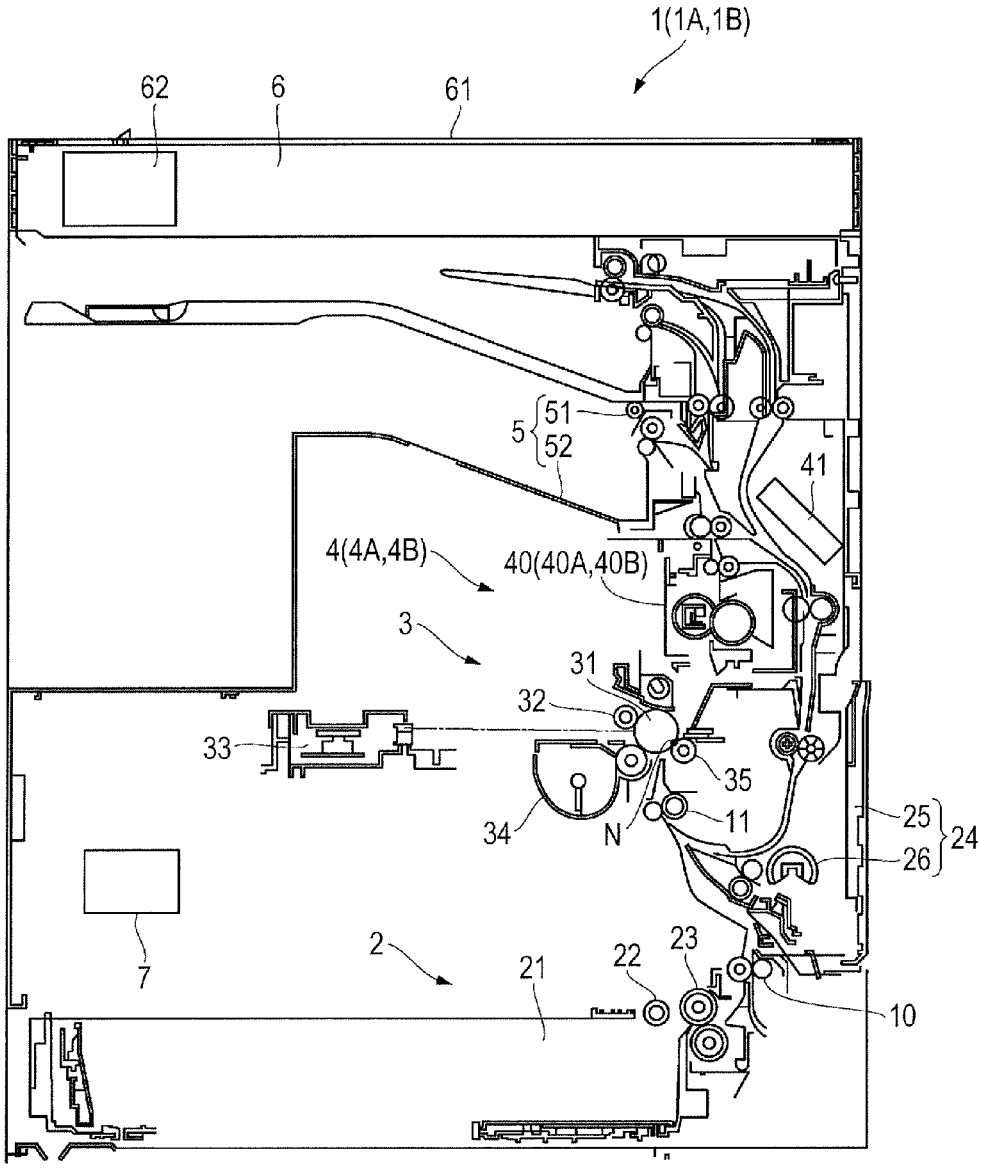
FIG. 1 is a sectional view schematically showing an overall configuration of a copier according to a first embodiment of the present invention.

First, the overall configuration of the copier 1 according to the first embodiment will be described with reference to FIG. 1. FIG. 1 is a sectional view schematically showing the overall configuration of the copier 1 according to the first embodiment of the present invention. Hereinafter, a near side where a user faces an operation panel, not shown, for various inputs and settings onto the copier 1 is referred to as a "front side"; a far side is referred to as a "rear side". That is, FIG. 1 is a sectional view from the front side showing an internal configuration of the copier 1.

As shown in FIG. 1, the copier 1 according to the first embodiment includes a sheet feeder 2 feeding a sheet S, an image forming device 3 as an image forming unit forming an image on the sheet S, a fixing section 4 fixing the image on the sheet S, an ejector 5 ejecting the image-fixed sheet S, an image reader 6 capable of reading an image of a document, and a controller 7.

The sheet feeder 2 is provided at a lower part of the copier 1, and includes a stack tray 21 on which sheets S are stacked, a pickup roller 22 picks up the sheet S stacked on the stack tray 21, and a separator-feeder 23 that separates and feeds the picked-up sheet S. In this embodiment, the sheet feeder 2 includes a manual feeder 24 by which the sheet S can be manually fed from a side of the copier 1. The manual feeder 24 includes a manual tray 25 on which the sheets S are stacked, and a separator-feeder that separates and feeds the sheet S stacked on the manual tray 25.

The image forming device 3 is provided above the sheet feeder 2, and includes a photosensitive drum 31 on which a toner image is formed, a charge roller 32 uniformly charging a surface of the photosensitive drum 31, a laser irradiation device 33 irradiating the photosensitive drum 31 with laser light to form an electrostatic latent image, a developing device 34 visualizing the electrostatic latent image on the photosensitive drum 31 as a toner image, and a transfer roller 35 in contact with the photosensitive drum 31 to form a transfer nip N.

The fixing section 4 is provided on a sheet conveying path on the downstream side of the image forming device 3 in the sheet conveying direction (hereinafter, simply referred to as the "downstream side"), and includes a fixing unit 40 and a cooling fan 41. The fixing section 4 will be described later in detail.

The ejector 5 is provided on the downstream side of the fixing section 4, and includes an eject roller pair 51 ejecting the sheet S from the inside of the main body of the apparatus, and an eject tray 52 on which the ejected sheet S is stacked. The image reader 6 is provided at an upper part of the copier 1, and includes a document mount 61 on which a document is mounted, and a reading scanner 62 reading image information of the document mounted on the document mount 61.

Next, an image forming job according to the controller 7 of the copier 1 according to the first embodiment configured as described above will be described. After the image forming job is started, the laser irradiation device 33 irradiates the surface of the photosensitive drum 31 with laser light according to the image information (image information signal) on the document transmitted from a personal computer, not illustrated, or the reading scanner 62. Accordingly, the surface of the photosensitive drum 31 uniformly charged to a potential with a prescribed polarity by the charge roller is exposed to light, thereby forming an electrostatic latent image on the surface of the photosensitive drum 31. The developing device 34 develops the electrostatic latent image formed on the photosensitive drum 31 to visualize the image as a toner image.

In parallel with the operation of forming the toner image, the sheet S separated and fed from the sheet feeder 2 on a sheet-by-sheet basis is transferred by a conveyor roller pair 10 to a resistance roller pair 11 provided on the downstream side of the conveyor roller pair 10 on the sheet conveying path, and the resistance roller pair 11 corrects skew. The skew-corrected sheet S is subsequently conveyed to the transfer nip N at a prescribed timing, and the visualized toner image is transferred by the transfer roller 35 onto the sheet S.

The sheet S on which the toner image is transferred is conveyed from the transfer nip N to the fixing section 4, and subjected to heat and pressure at the fixing unit 40. Accordingly, the toner is melted and fixed as an image. Subsequently, the image-fixed sheet S is ejected by the eject roller pair 51 onto the eject tray 52, and the image forming job is finished.

Figure 2:
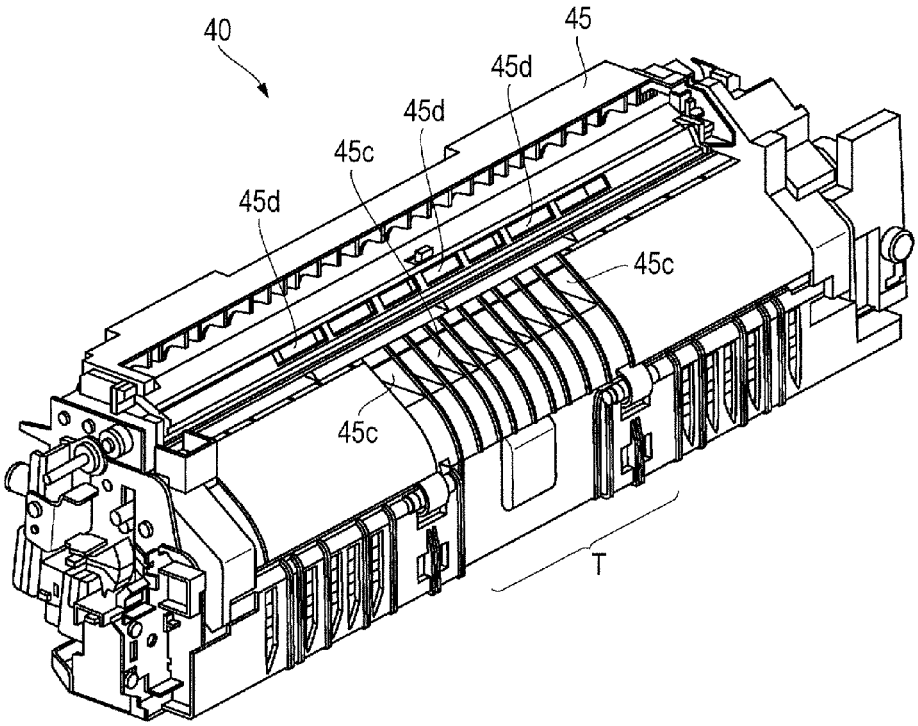
FIG. 2 is a perspective view from one side of a fixing unit of a fixing section according to the first embodiment.
Figure 3:
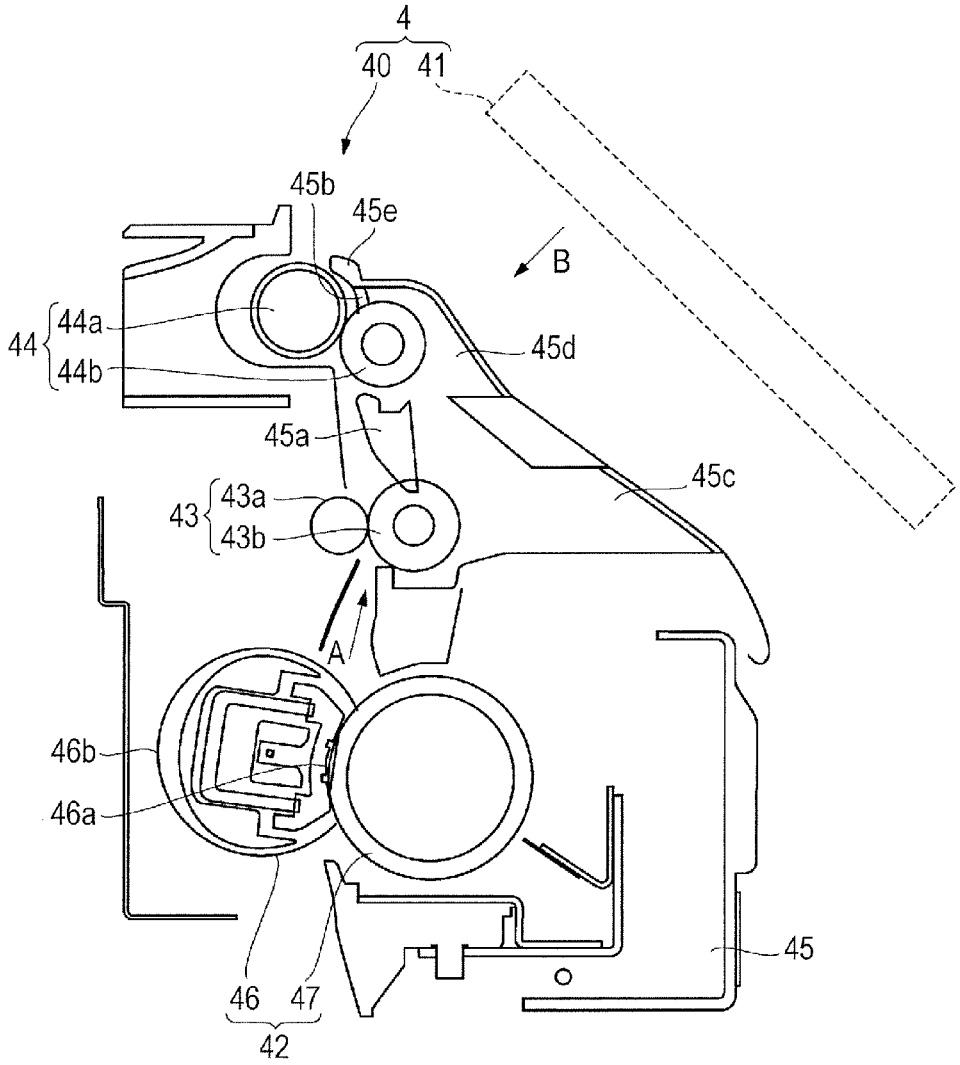
FIG. 3 is a sectional view schematically showing the fixing unit shown in FIG. 2.

Next, the fixing section 4 of the copier 1 according to the first embodiment will be described with reference to FIGS. 2 and 3 in addition to FIG. 1. FIG. 2 is a perspective view showing the fixing unit 40 of the copier 1 according to the first embodiment. FIG. 3 is a sectional view schematically showing the fixing unit 40 shown in FIG. 2.

As shown in FIG. 1, the fixing section 4 includes the fixing unit 40, and the cooling fan 41 configuring a temperature difference providing unit. As shown in FIGS. 2 and 3, the fixing unit 40 includes a fixing pair 42 as a fixing unit that fixes the unfixed toner image transferred to the sheet S, a first conveyor roller pair 43 provided on the downstream side of the fixing pair 42, a second conveyor roller pair 44 provided on the downstream side of the first conveyor roller pair 43, and a unit case 45 rotatably supporting the fixing pair 42, the first conveyor roller pair 43 and the second conveyor roller pair 44.

The fixing pair 42 includes a heater 46 heating the sheet S on the side of the image forming surface where the toner image is formed, and a pressure roller 47 that sandwiches and applies pressure to the sheet S with the heater 46. The heater 46 includes a heating element **46*a*, and an endless film 46*b* arranged around the heating element 46*a*. The pressure roller 47 is configured so as to be driven to rotate by a drive motor, not shown. The pressure roller 47 is disposed to apply pressure to the endless film 46*b* so as to allow the sheet S to be sandwiched with the heater 46** and conveyed.

The first conveyor roller pair 43 includes a first aluminum conveyor roller **43*a* arranged on the side of the heater 46 in the direction orthogonal to a sheet conveying direction A, and a first rubber conveyor roller 43*b* arranged on the side of the pressure roller 47. The first aluminum conveyor roller 43*a* is formed by wrapping a film made of fluoroplastic around an aluminum rod. The first rubber conveyor roller 43*b* is made of silicone rubber, and configured to be driven to rotate by a drive motor, not shown. The peripheral speed of the first rubber conveyor roller 43*b* is set so as to prevent the sheet S from being loosened between the roller pairs, and set to be 103% of the peripheral speed of the endless film 46*b*** in this embodiment.

The second conveyor roller pair 44 includes a second aluminum conveyor roller **44*a* arranged on the side of the heater 46 in a direction orthogonal to the sheet conveying direction A, and a second rubber conveyor roller 44*b* arranged on the side of the pressure roller 47. The second aluminum conveyor roller 44*a* is formed by wrapping a fluoroplastic film around an aluminum hollow tube. The second rubber conveyor roller 44*b* is formed of silicone rubber, and configured to be driven to rotate by a drive motor, not shown. The peripheral speed of the second rubber conveyor roller 44*b* is set so as to prevent the sheet S from being loosened between the roller pairs, and set to be 105% of the peripheral speed of the endless film 46*b*** in this embodiment.

The unit case 45 includes a first conveyance guide 45*a* provided between the first conveyor roller pair and the second conveyor roller pair 44, a second conveyance guide 45*b* that is provided in a curl state on the downstream side of the second conveyor roller pair 44 to configure a curl straightening unit, a plurality of first ventilation ducts 45*c* configuring a temperature difference providing unit capable of blowing air toward the first conveyor roller pair 43, and a plurality of second ventilation ducts 45*d* capable of blowing air toward the second conveyor roller pair 44.

The first conveyance guide 45*a* guides the sheet S conveyed by the first conveyor roller pair 43 to the second conveyor roller pair 44, while guiding air flowing from the first ventilation ducts 45*c* toward the second conveyor roller pair 44. The second conveyance guide 45*b* is formed into a curling shape, and configures a conveying path capable of correcting the curl at at least one end of the sheet S in the sheet conveying direction while the sheet S is conveyed by the second conveyor roller pair 44.

The plurality of first ventilation ducts 45*c* are disposed opposite to the cooling fan 41, and allow air blown from the cooling fan 41 to flow into the fixing unit 40, thereby cooling the sheet (passing sheet) conveyed from the first conveyor roller pair 43. The plurality of first ventilation ducts 45*c* having a width T (see FIG. 2) (e.g., ⅓ to ⅔ of the width of the sheet), 80% or less of the size in the maximum width direction, which can be conveyed by the copier 1, are provided at a substantially central portion in the sheet width direction, and provided at a substantially central portion of the fixing unit 40 in a width of 200 mm in this embodiment. Accordingly, only the central portion of the sheet S is cooled, thereby applying a relative temperature difference from the opposite ends. The plurality of second ventilation ducts 45*d* are disposed opposite to the cooling fan 41, allow air blown from the cooling fan 41 to circulate into the fixing unit 40, thereby cooling the sheet (passing sheet) conveyed by the second conveyor roller pair 44. The air flowing from the first ventilation ducts 45*c* and the second ventilation ducts 45*d* are discharged to the outside of the fixing unit 40 through a wind outlet 45*e* (see FIG. 3).

As shown in FIG. 1, the cooling fan 41 is disposed opposite to the first ventilation ducts 45*c* and the second ventilation ducts 45*d* of the fixing unit 40, and allows air outside of the main body of the apparatus to flow into the main body of the apparatus through a louver (air inlet), not shown, provided at the main body of the apparatus. The rotation rate of the cooling fan 41 is controlled by the controller 7 to allow the air flow rate to be controlled.

Next, a cooling job on the sheet S by the fixing section 4 controlled by the controller 7 of the copier 1 according to the first embodiment will be described. After the sheet S on which the toner image is transferred is conveyed from the transfer nip N to the fixing section 4, the fixing pair 42 heats and applies pressure to the unfixed toner image to melt the toner and fix an image.

At this time, the temperature of the surface of the sheet S in contact with the heater 46 is increased owing to heating by the heating element 46*a* of the heater 46. The temperature of the sheet S rises to a temperature at which the moisture included in the sheet S is evaporated. When the temperature of the sheet S rises to the temperature at which the moisture is evaporated, the evaporation of the moisture shrinks the surface in contact with the heater 46 and starts curling.

Figure 4:
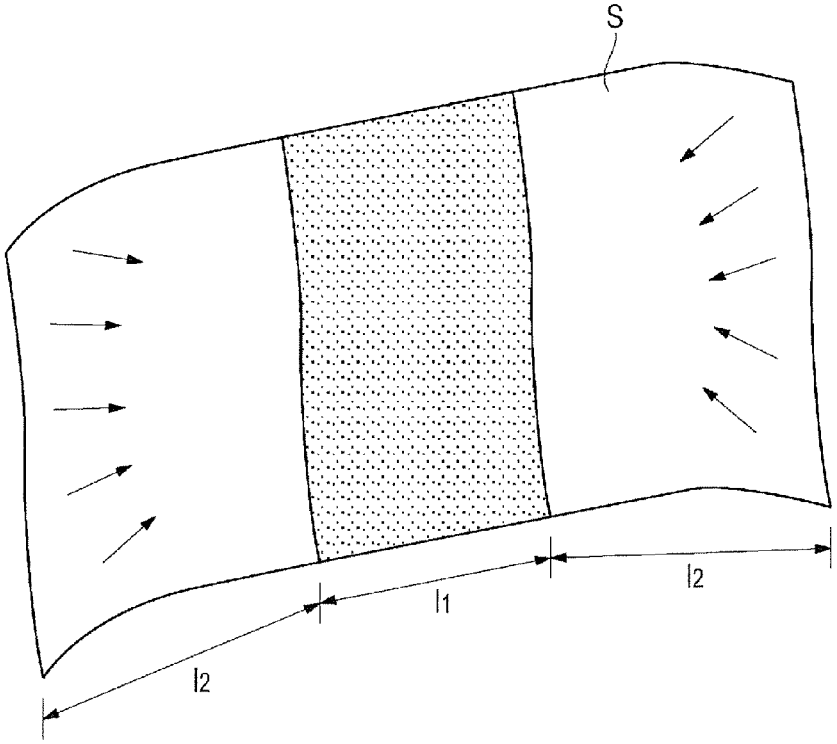
FIG. 4 is a perspective view for illustrating a curling state of a sheet.

Next, after the sheet S passes through the fixing pair 42, the sheet S is sandwiched by the first conveyor roller pair 43 and conveyed. Here, to the first conveyor roller pair 43, air is blown by the cooling fan 41 through the plurality of first ventilation ducts 45*c* provided at the substantially central portion of the fixing unit 40. That is, to the first conveyor roller pair 43, air is blown by the cooling fan 41 toward the substantially central portion of the sheet conveying path for conveying the sheet S. Accordingly, as shown in FIG. 4, the sheet S conveyed by the first conveyor roller pair 43 is cooled at the substantially central portion $l_1$ in the sheet width direction by ventilation by the cooling fan 41. The temperature of the cooled substantially central portion $l_1$ decreases, which suppresses evaporation of the moisture and shrink of the surface (shrink of fibers of paper). As to the drive timing of the cooling fan 41, for instance, the fan may be driven when the front end of the sheet S passes through the fixing pair 42, or the fan may be kept in a state of being preliminarily driven. Instead, a configuration may be adopted where, when a prescribed part (e.g., a half) of the sheet S has passed through the fixing pair 42, the air flow rate of the cooling fan 41 is decreased.

Meanwhile, the opposite ends $l_2$ of the sheet S in the sheet width direction are not cooled by the cooling fan 41. Accordingly, reduction in temperature at these ends is slow and evaporation of the moisture continues. Thus, the sheet S shrinks in the directions of arrows shown in FIG. 4 (shrinking directions of fibers of paper), and force to cause curl at opposite ends in the sheet width direction occurs. This suppresses the curl of the sheet S at the front end, and forms a gutter curl where the opposite ends in the sheet width direction (opposite ends parallel to the conveying direction) curl. As a result, for instance, even during conveyance of the sheet S sandwiched by the roller pair disposed on the downstream side (e.g., the second conveyor roller pair), a winding jam wrapping around the roller pair can be prevented from occurring.

The sheet S having passed through the first conveyor roller pair 43 is further cooled while being conveyed by the second conveyor roller pair 44. The sheet passes through the second conveyance guide 45*b* having a curling shape while being cooled, thereby straightening the curl. Accordingly, for instance, even in the case where the sheet S is conveyed by the roller pair disposed on the downstream side, a winding jam wrapping around the roller pair and the like can be prevented from occurring. After the sheet S passes the second conveyor roller pair 44 (is ejected from the fixing unit 40), the cooling job of the sheet S by the fixing section 4 is finished.

As described above, the copier 1 of this embodiment is configured such that the substantially central portion of the sheet S in the sheet width direction, having been heated by the fixing pair 42, can be quickly cooled by the cooling fan 41 and the first ventilation ducts 45*c*. Accordingly, a relative temperature difference between the opposite ends and the central portion of the sheet S in the sheet width direction can be quickly provided. This can prevent the curl at the front end in the sheet conveying direction by heating, and form a gutter curl where the sheet S curls in the sheet width direction. As a result, a winding jam where the sheet wraps around the conveyor roller pair and the like, which can occur owing to curling at the front end, can be prevented from occurring.

Second Embodiment

Figure 5:
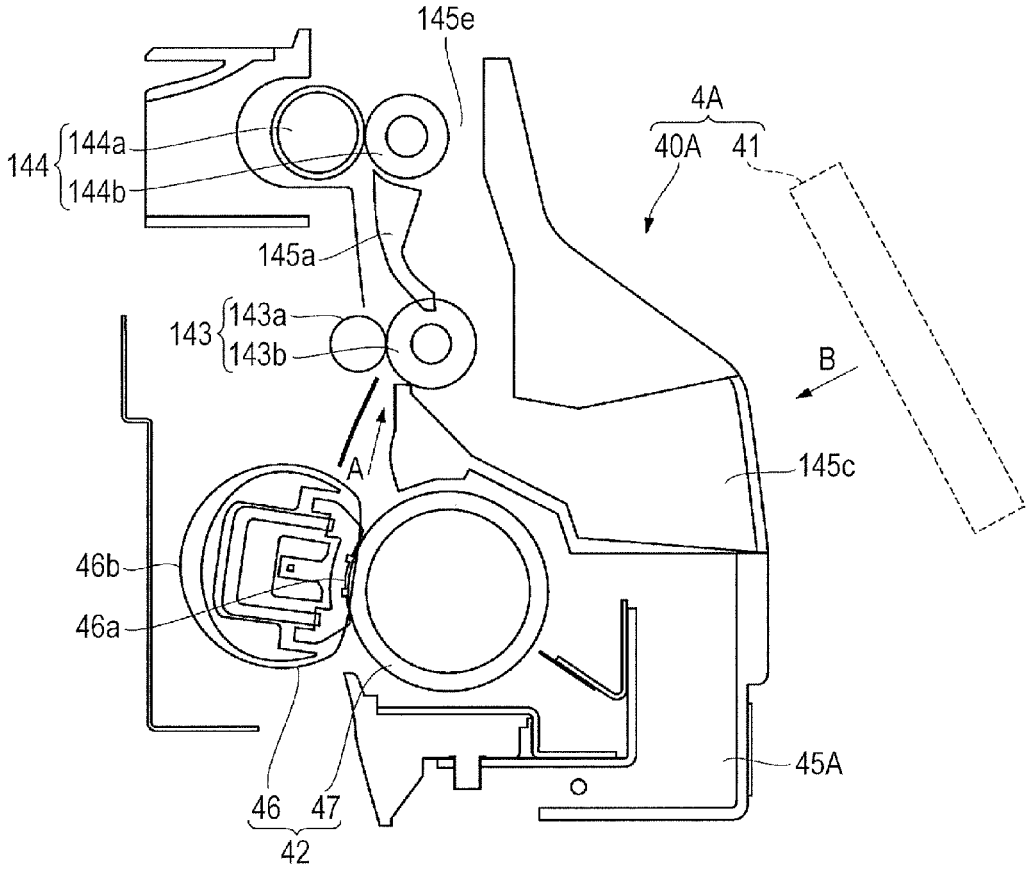
FIG. 5 is a sectional view schematically showing a fixing unit of a fixing section according to a second embodiment.
Figure 6:
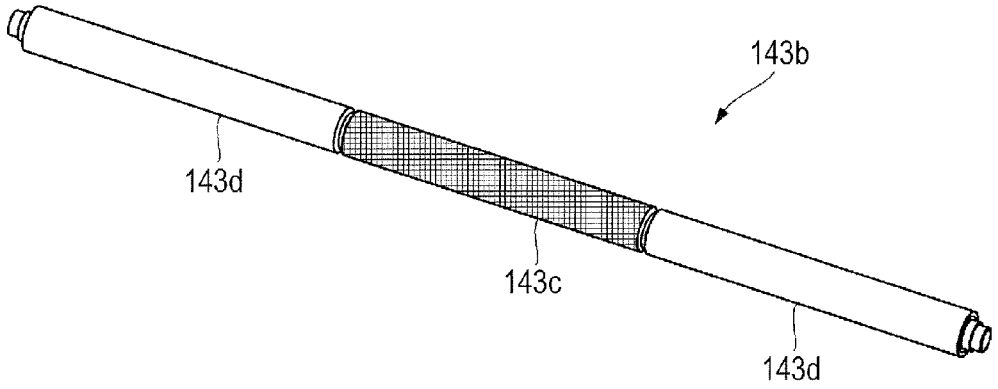
FIG. 6 is a perspective view showing a first conveyor roller of the fixing unit according to the second embodiment.
Figure 7:
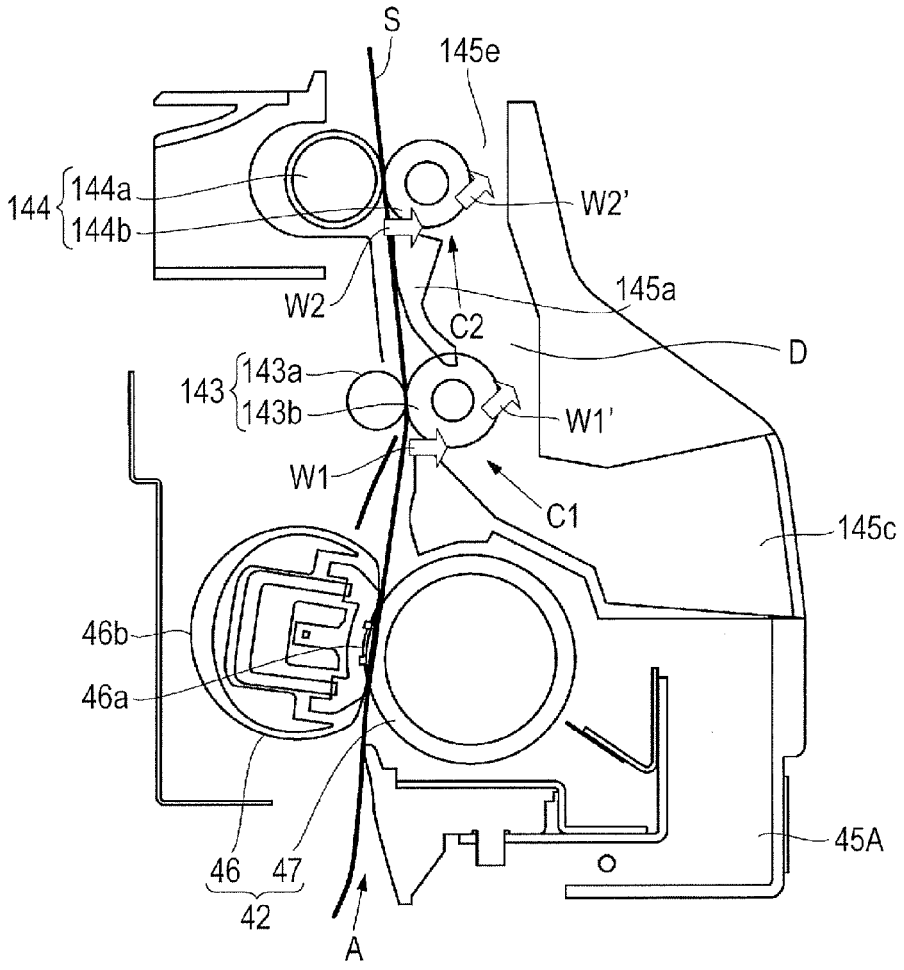
FIG. 7 is a sectional view showing a cooling state of a sheet passing through the fixing unit according to the second embodiment.
Figure 8:
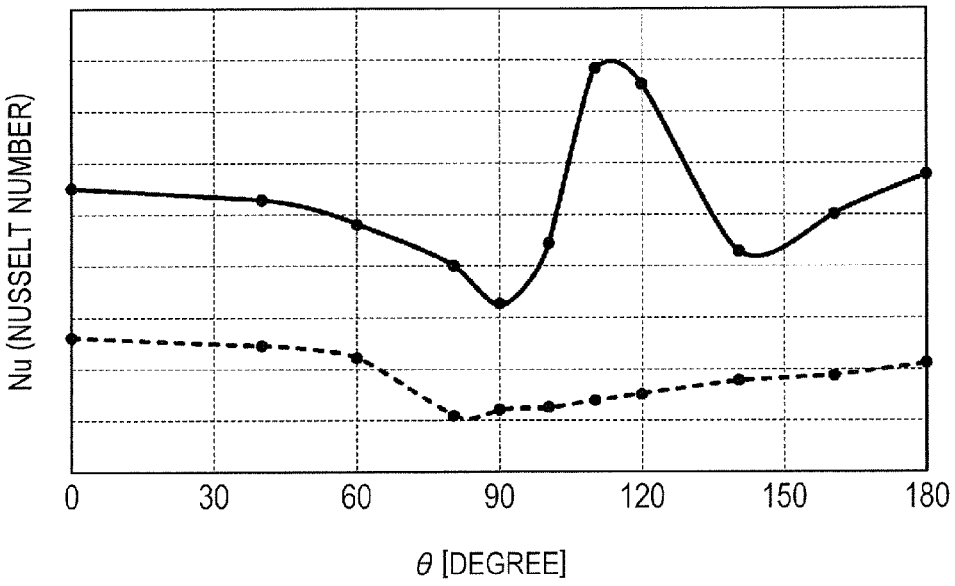
FIG. 8 is a diagram showing a difference in heat-transfer coefficient due to provision of a space.

Next, a copier 1A according to a second embodiment according to the present invention will be described with reference to FIGS. 5 to 8 in addition to FIG. 1. FIG. 5 is a sectional view schematically showing a cross-sectional surface of a fixing unit 40A of a fixing section 4A according to the second embodiment. FIG. 6 is a perspective view showing a first conveyor roller 143*b* of a fixing unit 40A according to the second embodiment. FIG. 7 is a sectional view showing a cooling state of a sheet S passing through the fixing unit 40A according to the second embodiment. FIG. 8 is a diagram showing a difference in heat-transfer coefficient due to provision of a space.

The copier 1A according to the second embodiment is different from that of the first embodiment, in the first conveyor roller pair, the second conveyor roller pair, and the unit case configuring the fixing unit of the fixing section. Thus, in the second embodiment, the difference from the first embodiment, that is, the first conveyor roller pair, the second conveyor roller pair and the unit case, will be mainly described. The elements having the configurations analogous to those of the copier 1 according to the first embodiment are assigned with the identical symbols; the description thereof is omitted.

As shown in FIG. 1, the copier 1A includes a sheet feeder 2, an image forming device 3, a fixing section 4A fixing an image on a sheet S, an ejector 5, an image reader 6 and a controller 7. The fixing section 4A is provided on a downstream side of the image forming device 3 on a sheet conveying path, and includes a fixing unit 40A and a cooling fan 41.

As shown in FIG. 5, the fixing unit 40A includes the fixing pair 42, a first conveyor roller pair 143 provided on the downstream side of the fixing pair 42, a second conveyor roller pair 144 provided on the downstream side of the first conveyor roller pair 143, and a unit case 45A rotatably supporting the fixing pair 42, the first conveyor roller pair 143 and the second conveyor roller pair 144.

The first conveyor roller pair 143 includes a first conveyor rod roller 143*a* arranged on the side of the heater 46 with respect to a direction orthogonal to the sheet conveying direction A, and a first conveyor roller 143*b* arranged on the side of the pressure roller 47. The first conveyor rod roller 143*a* is made of fluoroplastic. As shown in FIG. 6, the first conveyor roller 143*b* includes an aluminum section 143*c* as a heat absorption section having a high thermal conductivity, and silicone rubber sections 143*d* having a higher friction coefficient than the aluminum section 143*c*. The silicone rubber sections 143*d* convey the sheet S while the aluminum section 143*c* absorbs heat of the conveyed sheet S. In this embodiment, the aluminum section 143*c* is provided at a central portion in the sheet width direction, and the silicone rubber sections 143*d* are arranged at the opposite end parts of the aluminum section 143*c*. The aluminum section 143*c* is formed into a shape having a width 80% or less of the maximum sheet size in the width direction conveyable by the copier 1, and, in this embodiment, formed to have a width of 100 mm. The first conveyor roller 143*b* is configured so as to be driven to rotate by a drive motor, not shown. The peripheral speed of the first conveyor roller 143*b* is set to 103% of the peripheral speed of the endless film 46*b* so as to prevent the sheet S from being loosened between the roller pairs.

The second conveyor roller pair 144 has the same configuration as that of the first conveyor roller pair 143 except for the outer diameter. Accordingly, the above description is applied, and the description thereof is omitted here. The second conveyor roller pair 144 comprises a first conveyor roller 144*a* and a second conveyor roller 144*b*. The peripheral speed of the second conveyor roller 144*b* of the second conveyor roller pair 144 is set to 105% of the peripheral speed of the endless film 46*b* so as to prevent the sheet S from being loosened between the roller pairs.

The unit case 45A includes a first conveyance guide 145*a* provided between the first conveyor roller pair 143 and the second conveyor roller pair 144, a plurality of first ventilation ducts 145*c* configuring a temperature difference providing unit capable of blowing air toward the first conveyor roller pair 143, and a wind outlet 145*e* capable of venting air having flown from the first ventilation ducts 145*c*.

The first conveyance guide 145*a* guides the sheet S conveyed by the first conveyor roller pair 143 to the second conveyor roller pair 144, while guiding the air having flown from the first ventilation ducts 145*c* toward the second conveyor roller 144*b*. The air having flown from the first ventilation ducts 145*c* is vented from the wind outlet 145*e*, thereby allowing the first ventilation ducts 145*c* and the wind outlet 145*e* to configure a path of wind blowing on the surfaces of the aluminum section 143*c* of the first conveyor roller 143*b* and the aluminum section (not shown) of the second conveyor roller 144*b*.

Next, a cooling job on the sheet S by the fixing section 4A controlled by the controller 7 of the copier 1A according to the second embodiment will be described with reference to FIGS. 7 and 8. FIG. 7 is a sectional view showing a cooling state of the sheet S passing the fixing unit 40A according to the second embodiment. FIG. 8 is a diagram showing a difference in heat-transfer coefficient due to provision of a space.

After the sheet S on which a toner image is transferred is conveyed to the fixing section 4A from the transfer nip N, the fixing pair 42 heats and applies pressure to the unfixed toner image to melt the toner and form a fixed image. At this time, the temperature of the surface of the sheet S in contact with the heater 46 is increased owing to heating of the heating element 46*a* of the heater 46. The temperature of the sheet S rises to a temperature at which the moisture included in the sheet S is evaporated. When the temperature of the sheet S rises to the temperature at which the moisture is evaporated, the evaporation of the moisture shrinks the surface in contact with the heater 46 and starts curling.

Next, after the sheet S passes through the fixing pair 42, the sheet S is sandwiched by the first conveyor roller pair 143 and conveyed. Here, the first conveyor roller pair 143 includes the first conveyor roller 143*b* having the aluminum section 143*c* at the central portion. Accordingly, as shown in FIG. 7, when the sheet S sandwiched between the first conveyor roller pair 143 comes into contact with the aluminum section 143*c* of the first conveyor roller 143*b*, heat is transferred (W1). The aluminum section 143*c* has a higher thermal conductivity than the silicone rubber section 143*d*. Accordingly, the temperature of the sheet S is reduced at the central portion in the sheet width direction owing to contact with the aluminum section 143*c*. Likewise, when the sheet S is sandwiched between the second conveyor roller pair 144 disposed on the downstream side of the first conveyor roller pair 143, heat at the substantially central portion of the sheet S in the sheet width direction is transferred (W2) owing to contact with the aluminum section of the second conveyor roller 144*b*. Accordingly, the temperature of the substantially central portion of the sheet S in the sheet width direction is reduced.

The heat W1 transferred to the aluminum section 143*c* of the first conveyor roller 143*b* is radiated (W1'), and this section is cooled by air blown by the cooling fan 41 through the first ventilation ducts 145*c*. Likewise, the heat W2 transferred to the aluminum section of the second conveyor roller 144*b* is radiated (W2'), and the section is cooled by air blown by the cooling fan 41 through the first ventilation ducts 145*c*.

Meanwhile, at the opposite ends of the sheet S in the sheet width direction, heat conduction is small because the contact is made with the silicone rubber sections. Accordingly, reduction in temperature is slow and moisture is continuously evaporated. The evaporation shrinks the sheet S, and causes a force making the opposite ends in the sheet width direction curl. This force suppresses curling at the front end of the sheet S, and forms a gutter curl where the opposite ends in the sheet width direction curl. As a result, for instance, even in the case of conveyance of the sheet S sandwiched between the roller pairs disposed on the downstream side, a winding jam wrapping around the roller pair can be prevented from occurring.

Here, the air from the first ventilation ducts 145*c* is blown on the aluminum section 143*c* of the first conveyor roller 143*b* in the direction of an arrow C1 shown in FIG. 7. In this case, a space D is provided with respect to an air inlet position so as to open about 90 to 180 degrees with respect to an inlet position on the downstream side of the burble point of air (fluid). This arrangement is for transferring heat from the sheet S to the aluminum section 143*c* (W1') at a position with a high Nusselt number, which represents the strength of thermal conductivity between a known fluid and a substance, i.e., a thermal conductivity, as indicated by a solid line in FIG. 8. The solid line and a broken line shown in FIG. 8 show a difference in Nusselt number owing to a difference in a Reynolds number, which is a known constant. It is represented that the higher the Reynolds number, the larger the heat conduction is.

The air blown on the first conveyor roller 143*b* flows onto the aluminum section of the second conveyor roller 144*b* in the direction of an arrow C2 shown in FIG. 7, and heat conducted to the entire aluminum section is radiated before diffusion. The wind path of the air from the first ventilation ducts 145*c* to ventilation at the wind outlet 145*e* is configured so as to be narrowed near the first conveyor roller pair 143 to increase the flow rate of the blown air.

As described above, the copier 1A according to the second embodiment is provided with the aluminum section 143*c* as the heat absorption section at the substantially central portion of the first conveyor roller 143*b* of the first conveyor roller pair 143 conveying the sheet in the sheet width direction. Accordingly, the substantially central portion of the sheet S heated by the fixing pair can be cooled by the heat conduction. This cooling allows a relative temperature difference to be quickly provided between the substantially central portion and the opposite ends of the sheet S in the sheet width direction. As a result, curling at the front end in the sheet conveying direction due to heating is prevented; the sheet S can be formed into a gutter curl where the sheet curls in the sheet width direction; and a winding jam where the sheet wraps around the conveyor roller pair, which can be caused by curling at the front end, can be prevented from occurring.

Heat transferred to the aluminum section 143*c* is cooled by the cooling fan 41. Accordingly, unnecessary increase in heat in the aluminum section 143*c* is suppressed. Furthermore, air blown by the cooling fan 41 can also cool the sheet S, thereby allowing cooling efficiency to be increased.

Third Embodiment

Figure 9:
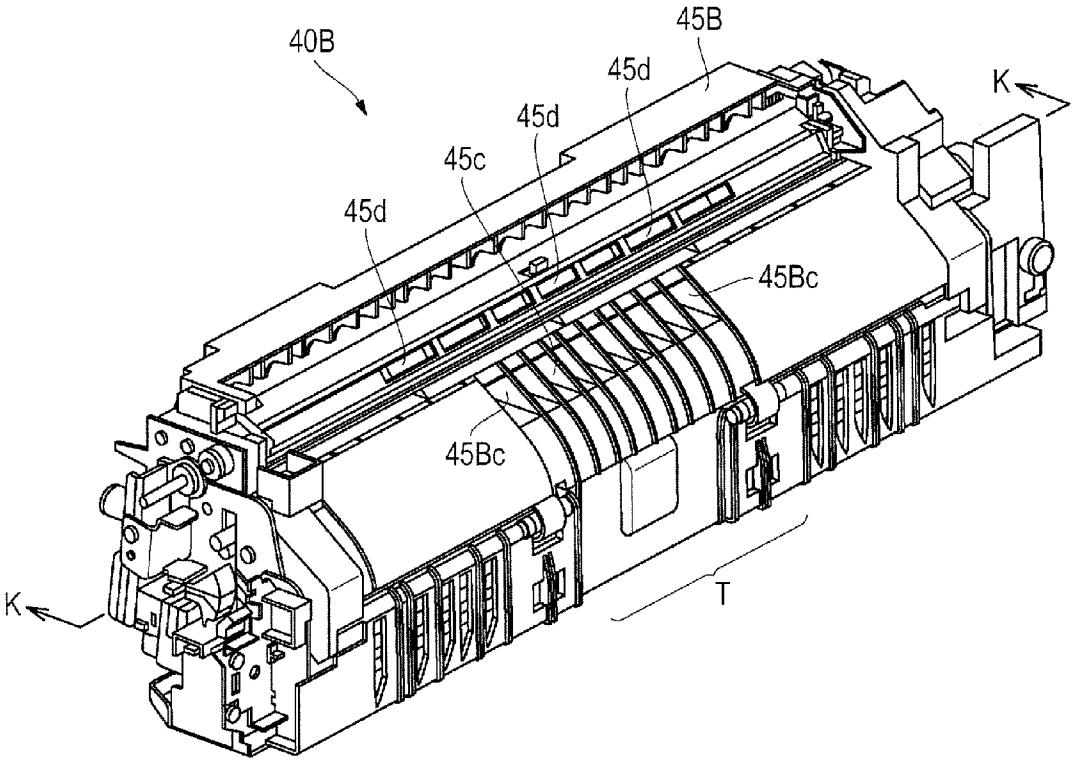
FIG. 9 is a perspective view from one side of a fixing unit of a fixing section according to a third embodiment.
Figure 10:
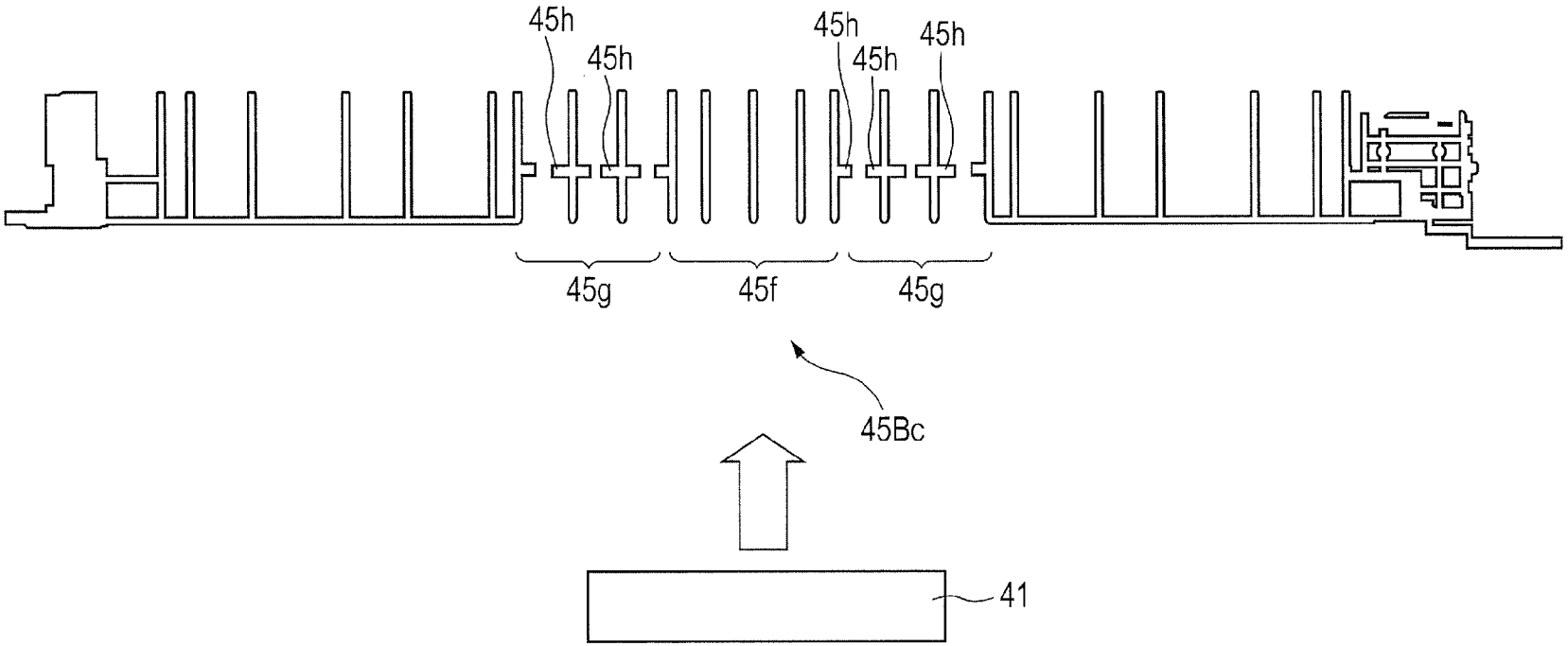
FIG. 10 is a sectional view of the fixing unit of the third embodiment taken along line K-K in FIG. 9.

Next, a copier 1B according to a third embodiment of the present invention will be described with reference to FIGS. 9 and 10 in addition to FIG. 1. FIG. 9 is a perspective view of a fixing unit 40B of a fixing section 4B according to the third embodiment from one side. FIG. 10 is a sectional view of the fixing unit 40B according to third embodiment taken along line K-K shown in FIG. 9.

The copier 1B according to the third embodiment is different from that of the first embodiment in the unit case configuring the fixing unit of the fixing section and control of the flow rate of air from the cooling fan. Accordingly, in the third embodiment, the difference from the first embodiment, that is, the unit case and the control of the flow rate of air from the cooling fan will be mainly described. The elements having the configurations analogous to those of the first embodiment are assigned with the identical symbols; the description thereof is omitted.

As shown in FIG. 1, the copier 1B includes a sheet feeder 2, an image forming device 3, a fixing section 4B fixing an image on a sheet S, an ejector 5, an image reader 6 and a controller 7. The fixing section 4B is provided on a sheet conveying path on the downstream side of the image forming device 3, and includes a fixing unit 40B and a cooling fan 41. The fixing unit 40B includes a fixing pair 42, a first conveyor roller pair 43, a second conveyor roller pair 44, and a unit case 45B rotatably supporting the fixing pair 42, the first conveyor roller pair 43 and the second conveyor roller pair 44.

The unit case 45B includes a first conveyance guide 45*a*, a second conveyance guide 45*b*, first ventilation ducts 45Bc configuring a temperature difference providing unit blowing air toward the first conveyor roller pair 43, and a plurality of second ventilation ducts 45*d*.

The first ventilation ducts 45Bc are disposed opposite to the cooling fan 41, and cause air blown from the cooling fan 41 into the fixing unit 40B to cool the sheet (passing sheet) conveyed by the first conveyor roller pair 43. The first ventilation ducts 45Bc are provided at the substantially central portion in the sheet width direction into a width T (see FIG. 9), 80% or less of the maximum sheet size in the width direction conveyable by the copier 1B (e.g., ⅓ to ⅔ of sheet width). In this embodiment, the ducts are provided at the substantially central portion of the fixing unit 40 in a width of 200 mm. Accordingly, only the substantially central portion of the sheet S is cooled, and a relative temperature difference with the opposite ends are provided.

Furthermore, as shown in FIG. 10, the first ventilation ducts 45Bc include a central duct 45*f* formed at a substantially central portion, and end ducts 45*g* and 45*g* provided at opposite ends of the central duct 45*f*. The central duct 45*f* is formed such that wind blown from the cooling fan 41 passes straight. Each of the end ducts 45*g* and 45*g* includes a protrusion 45*h* narrowing the interval between the ducts at a middle of the duct. The protrusion 45*h* narrows the interval between the ducts, thereby reducing the rate of wind passing between the ducts.

The controller 7 controls the rotation rate to allow the cooling fan 41 to control the air flow rate. In this embodiment, the rotation rate of the cooling fan 41 is switchable between a full speed and a half speed. Accordingly, the flow rate of air from the cooling fan 41 is switched. In this embodiment, the controller 7 is configured to allow the flow rate of air from the cooling fan 41 to be switched between two steps. The steps may be more than two. The air flow rate is not necessarily stepwise. Instead, the air flow rate may be continuously switched, which allows the air flow rate to be gradually increased.

Next, control of the flow rate of air from the cooling fan 41 by the controller 7 will be described. The controller 7 of the copier 1B according to the third embodiment changes the flow rate of air from the cooling fan 41 according to the size of the sheet S and the position (arrangement) where the sheet S passes. Description will be made below using the case of A4 landscape size and the case of A5 portrait size with a short length in the width direction. Hereinafter, the description will be made using a state where the cooling fan 41 is preliminarily driven. However, a configuration may be adopted where, when the front end of the sheet S passes the fixing pair 42, the cooling fan 41 is driven, and, when the front end passes the second conveyor roller pair 44, the fan is stopped.

The control of the flow rate of air from the cooling fan 41 when the sheet S having the A4 landscape size passes the fixing pair 42 will now be described. When a detection sensor, not shown, detects that the front end of the sheet S having the A4 landscape size has passed the fixing pair 42, the rotation rate of the cooling fan 41 is switched to the full speed to cool the sheet S. At this time, at the central duct 45*f*, the wind passes between the ducts without losing the air flow rate to cool the sheet S. Meanwhile, at the end ducts 45*g* and 45*g*, the air flow rate is lost by the protrusion 45*h*. However, the cooling fan 41 is rotated at the full speed. Accordingly, a certain amount of wind passes between the ducts to cool the sheet S. The substantially central portion of the sheet S is thus cooled.

Next, when the detection sensor, not shown, detects that the substantially central portion of the sheet S in the conveying direction passes the fixing pair 42 (half of the sheet passes), the rotation rate of the cooling fan 41 is switched to the half speed. At this time, as with the case of the full speed, at the central duct 45*f*, the wind flows between the ducts without losing the air flow rate to cool the sheet S. Meanwhile, at the end ducts 45*g* and 45*g*, the air flow rate is lost by the protrusion 45*h*. Accordingly, only a significantly small rate of air cools the sheet S.

Thus, in the case of the sheet S having the A4 landscape size, when the substantially central portion of the sheet S in the conveying direction passes the fixing pair 42, the cooling fan 41 is switched from the full speed to the half speed. In general, when the sheet S passes the fixing pair 42, heat is accumulated in the paper. Accordingly, an amount of heat is sufficiently kept at the front end of the sheet S. Thus, the amount of heat applied to the sheet S is larger at the front end, and the amount of curl tends to be large at the front end. Meanwhile, the accumulation of heat is small at the rear end of the sheet S, and the amount of heat applied to the sheet S is also smaller than that at the front end. Accordingly, the amount of curling tends to be small thereat. A larger amount of heat is therefore required to be removed at the front end of the sheet S. However, at the rear end of the sheet S, the heat as much as that at the front end is not necessarily removed. Thus, control of the cooling fan as described above can effectively prevent the curl from increasing. Heat is removed at the rear end of the sheet S, at which the amount of curling tends to be small, thereby further allowing the curl to be prevented from increasing.

Next, the air flow rate control on the cooling fan 41 when the A5 portrait sheet S passes the fixing pair 42 will be described. When the detection sensor, not shown, detects that the front end of the A5 portrait sheet S passes the fixing pair 42, the rotation rate of the cooling fan 41 is switched to the half speed to cool the sheet S. At this time, at the central duct 45*f*, the wind passes between the ducts without losing the air flow rate to cool the sheet S. Meanwhile, at the end ducts 45*g* and 45*g*, the air flow rate is lost by the protrusions 45*h*. Accordingly, only a significantly small rate of air cools the sheet S, and the cooling efficiency is reduced in comparison with that of the central duct 45*f*. This allows a temperature difference with the central duct 45*f* to be applied to the sheet S.

Thus, in the case of the A5 portrait sheet S, the cooling fan 41 is switched to the half speed to cool the sheet S. In the case of the sheet S having a short length in the width direction as with the A5 portrait sheet S, if the heat is removed from the entire area on which the central duct 45*f* and the end ducts 45*g* and 45*g* are projected, a width where the heat is not removed is significantly small in comparison with a width where the heat is removed. Accordingly, a sufficient temperature difference cannot sometimes be applied in the width direction of the sheet S. Meanwhile, the cooling fan 41 is controlled as described above, and then the wind from the central duct 45*f* cools the sheet S. Accordingly, the substantially central portion of the sheet having a short length in the width direction as with the A5 portrait sheet S can be appropriately cooled. Thus, a temperature difference is appropriately provided, which can prevent curling from occurring.

As described above, in the copier 1B according to the third embodiment, the first ventilation ducts 45Bc include the end ducts 45*g* and 45*g*, and the rotation rate of the cooling fan 41 is changed in accordance with the size in the width direction of the sheet S. Accordingly, even in the case where the size of the conveyed sheet S is changed, the substantially central portion of the sheet S can be effectively cooled. This allows a relative temperature difference to be provided between the substantially central portion and the opposite ends in the sheet width direction of the sheet S. As a result, curling at the front end in the sheet conveying direction due to heating can be prevented; the sheet S can be formed into a gutter curl where the sheet S curls in the sheet width direction; and a winding jam, in which the sheet wraps around the conveyor roller pair and which can be caused by curling at the front end, can be prevented from occurring.

Fourth Embodiment

Figure 11:
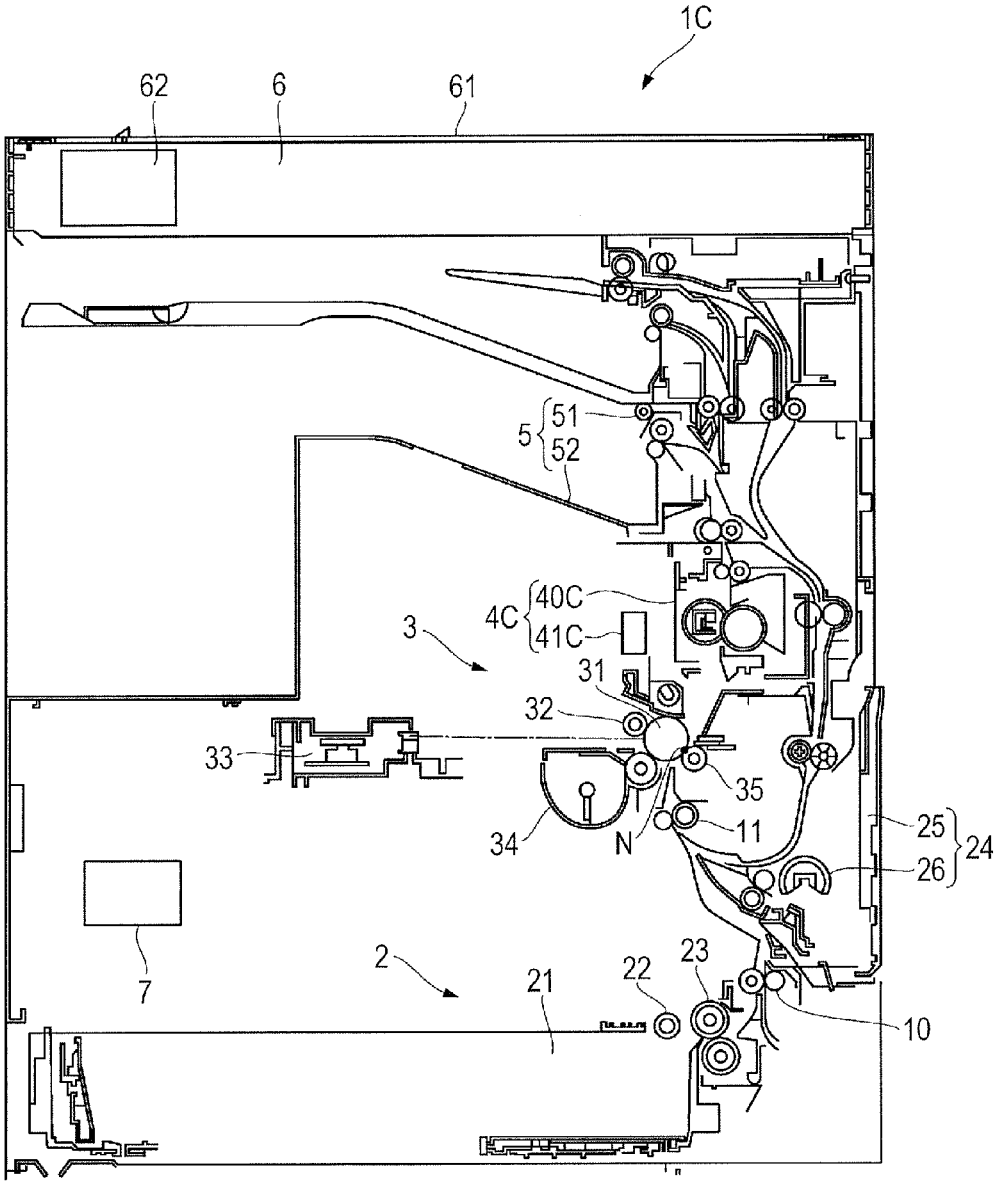
FIG. 11 is a sectional view schematically showing an overall configuration of a copier according to a fourth embodiment.
Figure 12:
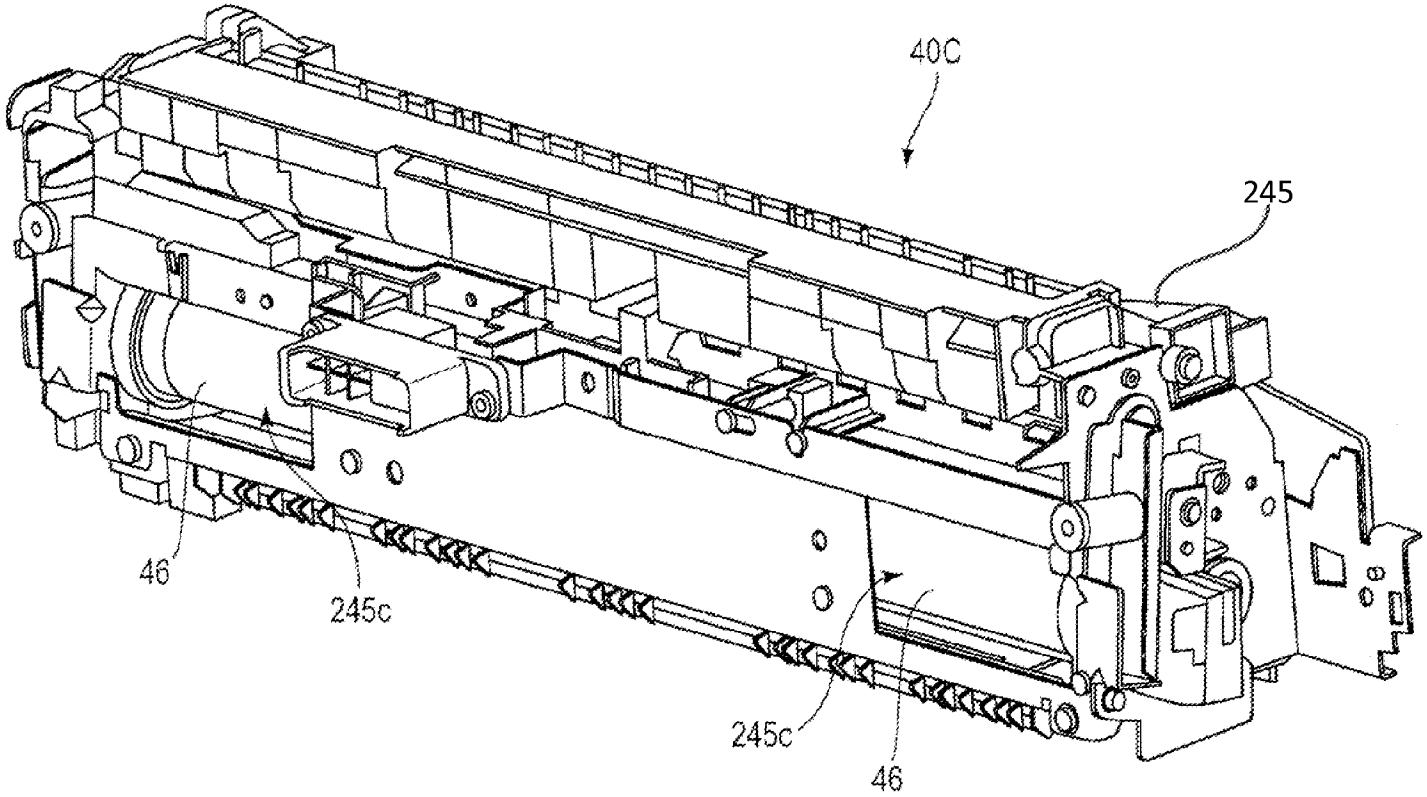
FIG. 12 is a perspective view from the other side of a fixing unit of a fixing section according to the fourth embodiment.
Figure 13B:
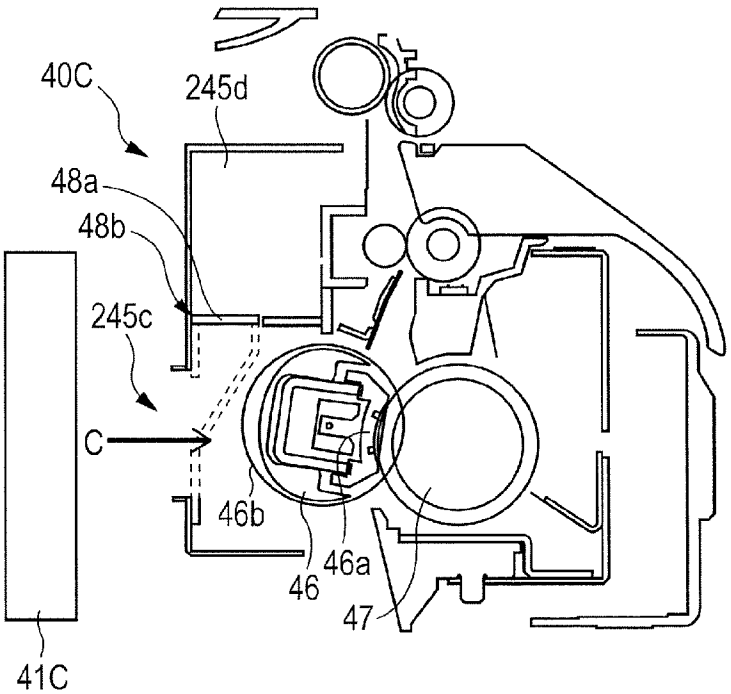
FIG. 13B is a sectional view schematically showing the fixing unit shown in FIG. 12.
Figure 13A:
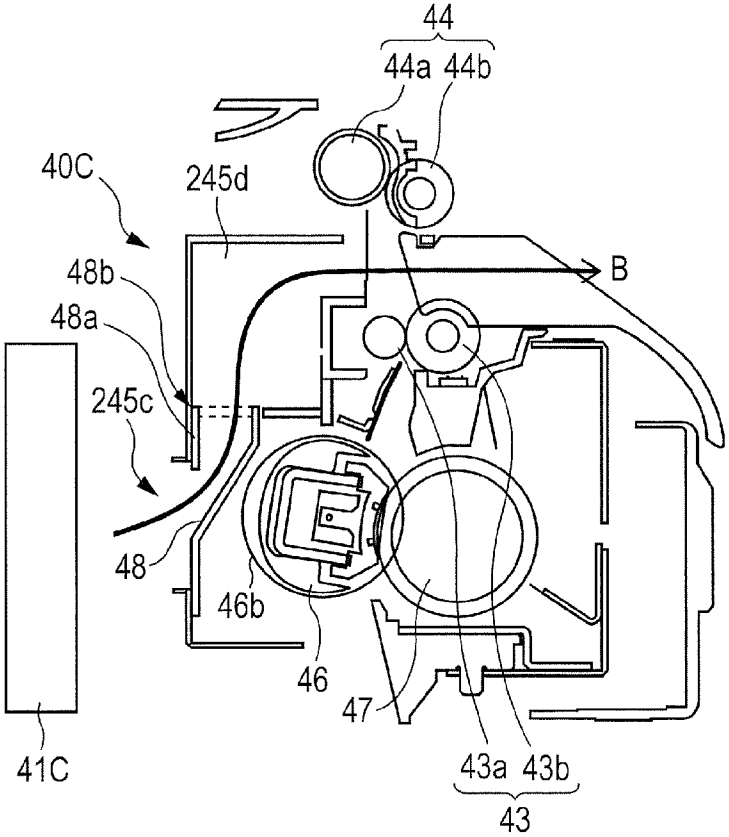
FIG. 13A is a sectional view schematically showing the fixing unit shown in FIG. 12.

Next, a copier 1C according to a fourth embodiment of the present invention will be described with reference to FIGS. 11 to 13A and 13B. FIG. 11 is sectional view schematically showing the overall configuration of the copier 1C according to the fourth embodiment. FIG. 12 is a perspective view showing a fixing unit 40C of a fixing section 4C according to the fourth embodiment in view of the other side. FIGS. 13A and 13B are sectional views schematically showing a cross-sectional surface of the fixing unit 40C shown in FIG. 12.

The copier 1C according to the fourth embodiment is different from that of the first embodiment, in a mode of blowing air into the unit case by the cooling fan. Accordingly, in the fourth embodiment, the difference from the first embodiment, that is, the mode of blowing air into the unit case by the cooling fan, will be mainly described. The elements having the configurations analogous to those of the first embodiment are assigned with the identical symbols; the description thereof is omitted.

As shown in FIG. 11, the copier 1C includes a sheet feeder 2, an image forming device 3, a fixing section 4C fixing an image on a sheet S, an ejector 5, an image reader 6 and a controller 7. The fixing section 4C is provided on a sheet conveying path on the downstream side of the image forming device 3, and includes a fixing unit 40C and a cooling fan 41C. The fixing unit 40C includes a fixing pair 42, a first conveyor roller pair 43, a second conveyor roller pair 44, and a unit case 245 rotatably supporting the fixing pair 42, the first conveyor roller pair 43 and the second conveyor roller pair 44.

As shown in FIGS. 12, 13A and 13B, the unit case 245 includes openings 245*c*, shutters 48 that open and close the openings 245*c*, ducts 245*d* causing air blown from the opening 245*c* to flow between the first conveyor roller pair 43 and the second conveyor roller pair 44, and turning shutters 48*a* that are turned to open and close the openings of the ducts 245*d*.

The openings 245*c* are formed at positions opposite to the heater 46 at both ends of the unit case 245 in the width direction. In this embodiment, the openings 245*c* are formed to have a width of 50 mm at both the ends in the width direction of the unit case 245. The shutter 48 is supported by the main body of the unit case 245 in a manner movable in the front and rear direction in FIGS. 13A and 13B. The turning shutter 48*a* is supported by the main body of the unit case 245 in a manner of allowing a shutter end 48*b* to be rotated. Both the shutters are driven by a drive motor, not shown, controlled by the controller 7. In a state where the shutter 48 and the turning shutter 48*a* are opened (see FIG. 13A), air blown from the cooling fan 41C is caused to flow through the duct 245*d*. In a closed state (see FIG. 13B), air blown from the cooling fan 41 is caused to flow to the opposite ends in the width direction of the heater 46. In the state where the shutter 48 and the turning shutter 48*a* are opened, the duct 245*d* allows the air blown from the cooling fan 41*c* through the opening 245*c* to flow between the first conveyor roller pair 43 and the second conveyor roller pair 44.

The cooling fan 41C is disposed opposite to the opening 245*c*, and blows air from the opening 245*c* into the unit case 245.

Next, control of opening and closing the shutter 48 and the turning shutter 48*a* by the controller 7 will be described. The controller 7 of the copier 1C according to the fourth embodiment controls the open and close states of the opening 245*c* due to the shutter 48 and the turning shutter 48*a* according to the size of the sheet S. Description will be made below using the case of the A4 landscape size and the case of an A5 portrait size having a short length in the width direction. Hereinafter, the description will be made using a state where the cooling fan 41 is preliminarily driven. Instead, a configuration may be adopted where, when the front end of the sheet S passes the fixing pair 42, the cooling fan 41 is driven and, when the front end passes the second conveyor roller pair 44, the fan is stopped.

Control of opening and closing the shutter 48 and the turning shutter 48*a* when the sheet S having the A4 landscape size passes the fixing pair 42 will be described. When the detection sensor, not shown, detects that the front end of the sheet S having the A4 landscape size passes the fixing pair 42, the controller 7 performs control of opening the shutter 48 and the turning shutter 48*a*. When the controller 7 opens the shutter 48 and the turning shutter 48*a*, the wind is blown from the cooling fan 41C onto the shutter 48 to thereby transferred to the duct 245*d* as shown in FIG. 13A. The air is then transferred to an interval between the first conveyor roller pair 43 and the second conveyor roller pair 44 through the duct 245*d* in the direction of an arrow B.

In this state, when the sheet S is conveyed by the first conveyor roller pair 43, the opposite ends of the sheet S in the width direction are cooled. Accordingly, only a substantially central portion of the sheet S in the width direction curls owing to heat, and then formation of curling at the opposite ends in the width direction is suppressed. This allows occurrence of curling at the front end of the sheet S in the conveying direction to be suppressed. As a result, a winding jam, in which the sheet wraps around the conveyor roller pair and which can be caused owing to curling at the front end, can be prevented from occurring.

Next, control of opening and closing the shutter 48 and the turning shutter 48*a* when the A5 portrait sheet S passes the fixing pair 42 will be described. When the detection sensor, not shown, detects that the front end of the A5 portrait sheet S passes the fixing pair 42, the controller 7 performs control of closing the shutter 48. When the controller 7 closes the shutter 48 and the turning shutter 48*a*, air blown from the cooling fan 41C is transferred to the opposite ends of the heater 46 in the width direction in the direction of an arrow C as shown in FIG. 13B. Accordingly, the endless film 46*b* arranged around the heating element 46*a* at the opposite ends of the heater 46 is cooled. This prevents the heat of the heating element 46*a* from being transferred to the conveyed sheet S. Accordingly, unnecessary increase in temperature of the endless film 46*b* is suppressed. As a result, breakage of the endless film 46*b* due to increase in temperature can be prevented.

As described above, in the copier 1C according to the fourth embodiment, the unit case 245 includes the shutter 48 and the turning shutter 48*a*. The shutter 48 and the turning shutter 48*a* are opened and closed according to the size of the conveyed sheet to transfer air into the unit case 245. Accordingly, for instance, in the case of conveying the sheet S that is long in the width direction as with the A4 landscape size, the opposite ends thereof are cooled, which can prevent the front end from curling. For instance, in the case of conveying the sheet S having a short length in the width direction as with the A5 portrait size, the heat of the heating element 46*a* at the opposite ends of the heater 46 is not transferred to the conveyed sheet S, which can prevent breakage due to unnecessary increase in temperature of the endless film 46*b*. That is, both the cooling of the sheet S and the cooling of the endless film 46*b* of the heater 46 can be realized.

The embodiments of the present invention have been described. The present invention is not limited to the above embodiments. The advantageous effects described in the embodiments of the present invention are only exemplification of most preferred advantageous effects exerted by the present invention. The advantageous effects of the present invention are not limited to those described in the embodiments of the present invention.

For instance, in this embodiment, a part of the sheet width direction, which is the substantially central portion of the sheet S in the sheet width direction, is cooled, thereby causing the opposite ends of the sheet S in the sheet width direction to curl. This is because the reference of conveying the sheet S is a reference at the center, and even if sheets having different sizes are conveyed, the sheet necessarily passes the center of the conveying path, and the configurational elements, such as ventilation ducts, are easily configured in one site at the center. However, the present invention is not limited thereto. For instance, a configuration may be adopted where the opposite ends or one end in the sheet width direction is cooled to cause at least one position of the sheet S in the sheet width direction to curl. Instead, a configuration may be adopted where a plurality of positions in the sheet width direction are cooled to form the sheet into a wavy shape (curls at the plurality of positions) in the sheet width direction.

In this embodiment, the cooling fan 41 as the temperature difference providing unit blows air toward the sheet to cool this sheet. However, the present invention is not limited thereto. For instance, a configuration may be adopted where hot air is blown to the substantially central portion and the opposite ends in the sheet width direction to cause the opposite ends of the sheet S to curl in the sheet width direction. That is, any configuration may be adopted only if the temperature difference is applied in the sheet width direction to curl the sheet S. As with the above description, the positions to which air is blown are not limited to the central position. The position may be the opposite ends or one end.

In the third embodiment, the first ventilation ducts 45Bc include the end ducts 45*g* to lose the air flow rate, thereby changing the cooling range. However, the present invention is not limited thereto. For instance, a shutter capable of changing the ventilation area may be provided at the first ventilation ducts 45*c* to configure the ventilation area according to the sheet width. Instead, a plurality of cooling fans corresponding to the respective first ventilation ducts 45*c* are provided to control and drive the plurality of cooling fans, thereby configuring a ventilation area.

The configuration adopted in the copier 1C according to the fourth embodiment may be applied to the copier 1 according to the first embodiment. That is, the unit case 45 of the copier 1 according to the first embodiment may be provided with an opening and a shutter, and a cooling fan is disposed at a position opposite to the opening. Combination of the configuration of the copier 1 according to the first embodiment and the configuration of the copier 1C according to the fourth embodiment can more effectively realize cooling of the sheet S and cooling of the endless film 46*b* of the heater 46.

Instead, the unit case 45 of the copier 1 according to the first embodiment may be provided with an opening and a shutter, and the cooling fan adopted in the copier 1C according to the fourth embodiment may be disposed at a position opposite to the opening to be used only for cooling an end of the fixing device instead of using for cooling the opposite ends of the sheet S in the width direction. Accordingly, the configuration is realized where an end of the endless film 46*b* whose temperature has risen owing to continuous passing of small-sized sheets is cooled by one cooling unit from the side of the endless film 46*b* of the fixing device, and the substantially central portion of the sheet S in the sheet width direction heated by the fixing pair 42 is cooled by the other cooling unit from an opposite position sandwiching the fixing device. This configuration can cause the independent cooling units to cool the ends of the fixing device and to cool the sheet S. Accordingly, intended cooling can be effectively executed. The cooling units are allowed to be disposed at opposite positions, which enables the units to be disposed more freely than the case of arrangement in the vertical direction.

According to the present invention, the relative temperature difference is provided in the sheet width direction of the conveyed sheet. Thus, a winding jam of the sheet can be prevented from occurring by causing at least one position to curl in parallel to the sheet conveying direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-006216, filed Jan. 16, 2012, and No. 2012-265231, filed Dec. 4, 2012 which are hereby incorporated by reference herein in their entirety.

What is claimed is:

1. An image forming apparatus, comprising:

an image forming unit that forms a toner image, and transfers the formed toner image onto a sheet;

a fixing unit that heats the sheet onto which the toner image is transferred by the image forming unit to fix the toner image on the sheet;

a plurality of conveyor rollers that are disposed downstream of the fixing unit in a sheet conveying direction, and that conveys the sheet on which the toner image is fixed by the fixing unit; and a temperature difference providing unit that is configured to provide a relative temperature difference for the conveyed sheet such that the temperature of a first area of the conveyed sheet is different from that of a second area of the conveyed sheet, which is different from the first area, in a sheet width direction intersecting the sheet conveying direction of the conveyed sheet, by performing a predetermined air-blowing operation toward the first area, at a position between the fixing unit and a conveyor roller other than the most downstream conveyor roller of the plurality of conveyor rollers.

2. The image forming apparatus according to claim 1, wherein the temperature difference providing unit includes a fan blowing air, and a ventilation duct causing the air blown from the fan to flow to the first area of the conveyed sheet in the sheet width direction.

3. The image forming apparatus according to claim 1, further comprising a curl correcting unit that is configured to correct a curl of the sheet on a downstream side of the temperature difference providing unit in the sheet conveying direction.

4. An image forming apparatus, comprising:

an image forming unit that forms a toner image, and transfers the formed toner image onto a sheet;

a fixing unit that heats the sheet onto which the toner image is transferred by the image forming unit to fix the toner image on the sheet;

a plurality of conveyor rollers that are disposed downstream of the fixing unit in a sheet conveying direction, and conveys the sheet on which the toner image is fixed by the fixing unit; and a temperature difference providing unit that provides a relative temperature difference for the conveyed sheet such that the temperature of a first area of the conveyed sheet is different from that of a second area of the conveyed sheet, which is different from the first area, in a sheet width direction intersecting the sheet conveying direction of the conveyed sheet, by performing a predetermined air-blowing operation toward the first area, around a conveyor roller closest to the fixing unit of the plurality of conveyor rollers.

5. An image forming apparatus, comprising:

an image forming unit that forms a toner image, and transfers the formed toner image onto a sheet;

a fixing unit that heats the sheet onto which the toner image is transferred by the image forming unit to fix the toner image on the sheet; and a temperature difference providing unit that provides a relative temperature difference for a conveyed sheet such that the temperature of a first area of the conveyed sheet is different from that of a second area of the conveyed sheet, which is different from the first area, in a sheet width direction intersecting a sheet conveying direction of the conveyed sheet by performing a predetermined air-blowing operation toward the first area, in a sheet conveying path between the fixing unit and a branching position where the sheet conveying path of the sheet, on which the toner image is fixed by the fixing unit, branches, the branching position being positioned downstream of the fixing unit.

6. The image forming apparatus according to claim 5, wherein the temperature difference providing unit includes a fan blowing air, and a ventilation duct causing the air blown from the fan to flow to the first area of the conveyed sheet in the sheet width direction.

7. The image forming apparatus according to claim 5, further comprising a curl correcting unit that is configured to correct a curl of the sheet on a downstream side of the temperature difference providing unit in the sheet conveying direction.

* * * * *